US005980020A

United States Patent [19]

Miura et al.

[11] Patent Number: 5,980,020

[45] **Date of Patent: *Nov. 9, 1999**

[54] INK-JET PRINTING APPARATUS AND INK-JET HEAD UNIT

[75] Inventors: Yasushi Miura, Kawasaki; Tokihide Ebata; Eiichi Takagi, both of Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/504,311

[22] Filed: Jul. 20, 1995

[30] Foreign Application Priority Data

Jul. 21, 1994 [JP] Japan ..... 6-169744

[51] Int. Cl.[6] ..... B41J 2/145; B41J 2/15; B41J 2/155; B41J 2/045

[52] U.S. Cl. ..... 347/41; 347/42; 347/71

[58] Field of Search ..... 347/15, 41, 43, 347/42, 71

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,410,991 | 8/1983 | Martin | 347/41 |
| 4,459,600 | 7/1984 | Sato et al. . | |
| 4,463,359 | 7/1984 | Ayata et al. . | |
| 4,558,333 | 12/1985 | Sugitani et al. . | |
| 4,723,129 | 2/1988 | Endo et al. . | |
| 4,740,796 | 4/1988 | Endo et al. . | |
| 4,922,271 | 5/1990 | Nilsson et al. . | |
| 4,985,710 | 1/1991 | Drake et al. . | |
| 5,117,374 | 10/1992 | Goetz | 347/12 |
| 5,353,051 | 10/1994 | Katayama et al. | 347/13 |
| 5,359,355 | 10/1994 | Nagoshi et al. | 347/40 |
| 5,455,610 | 10/1995 | Harrington | 347/43 |
| 5,485,183 | 1/1996 | Zandian et al. | 347/41 |
| 5,621,440 | 4/1997 | Takahashi | 347/12 |

FOREIGN PATENT DOCUMENTS

| | | | |
|---|---|---|---|
| 0034060 | 8/1981 | European Pat. Off. . | |
| 0440469 | 8/1991 | European Pat. Off. . | |
| 0551013 | 7/1993 | European Pat. Off. . | |
| 558236 | 9/1993 | European Pat. Off. | 347/43 |
| 59-123670 | 7/1984 | Japan . | |
| 59-138461 | 8/1984 | Japan . | |
| 62-057750 | 12/1987 | Japan . | |
| 63-031594 | 6/1988 | Japan . | |

*Primary Examiner*—N. Le
*Assistant Examiner*—Thinh Nguyen
*Attorney, Agent, or Firm*—Fitzpatrick, Cella, Harper & Scinto

[57] ABSTRACT

An ink-jet print head comprises a plurality of heater boards as unit substrates which are connected to each other and each of which has a plurality of discharge elements arranged therein so that the nonuniformity of density which would ordinarily be produced in portions of the image printed by the head corresponding to boundaries between the respective heater boards is decreased. Since a plurality of ink-jet heads are disposed so that the boundaries between respective heater boards of the heads do not overlap one another, the potential nonuniformity of density at the boundaries can be decreased by interrelation between the heads.

17 Claims, 14 Drawing Sheets

CONVENTIONAL EXAMPLE
D(C,M)
D(M)
D(C)
PRINTING AREA
L
L
L
L
603
602
601
600

EMBODIMENT OF THIS INVENTION
D(C,M)
D(M)
D(C)
PRINTING AREA
603
602
601
600
DISTRIBUTION OF PRINT DENSITY
POSITIONAL RELATION AMONG HEADS

FIRST SCAN
H FEED AMOUNT
L

SECOND SCAN
H FEED AMOUNT

DENSITY DISTRIBUTION
D(1) D(2) D(1,2)
THIRD SCAN
H FEED AMOUNT

INK-JET PRINTING APPARATUS AND INK-JET HEAD UNIT

BACKGROUND OF THE INVENTION

1. Field of the Invention

The present invention relates to an ink-jet printing apparatus and a printing head used in the apparatus, and particularly to a construction which uses a relatively long print head.

In this specification, "printing" includes "textile printing", and "fixing of a dye to a printing medium" includes "fixing of a dye to a printing medium to the extent that substantially no discoloration occurs by washing".

2. Description of the Related Art

A typical example of conventional textile printing methods is a screen textile printing method of printing directly on cloth or the like by using silk screen plates. The screen textile printing method is a method in which a screen plate is formed for each of the colors used in an original image, and cloth is dyed with ink of each color by transferring the ink directly thereto through the meshes of the silk screen.

In this screen textile printing method, many man-hours and days are required for forming the screen plates, and the work of preparing an ink of each of colors required for printing and the work of registering the screen plates are also required. The size of the apparatus used is large and increases in proportion to the number of the colors used, and a large space for installing the apparatus is thus required. A space for storing the screen plates is also required.

On the other hand, an ink-jet recording apparatus has been brought into practical use as a recording apparatus having the function as a printer, a copying machine, a facsimile, etc., and a recording apparatus used as an output device of a composite electronic apparatus and a work station comprising a computer, a word processor, etc. It has been suggested that such an ink-jet recording apparatus be used for textile printing by discharging an ink directly onto a cloth (for example, Japanese Patent Publication Nos. 62-57750 and 63-31594).

In the ink-jet recording apparatus, recording is performed by discharging an ink to a recording material from recording means (recording head). The recording apparatus has the advantages that the recording means can easily be made compact, that a high-definition image can be recorded at a high speed, that the running cost is low, that there is less noise because it is a non-impact system, and that a color image can easily be recorded by using multi-color inks.

Particularly, since the ink-jet recording means (recording head) for discharging ink by utilizing thermal energy comprises electro-thermal converters, electrodes, channel walls, a top plate, etc. which are formed through a semiconductor manufacturing process comprising etching, evaporation, sputtering, etc., recording means having a high-density channel arrangement (arrangement of discharge openings) can readily be produced, and can be made further compact.

A serial type recording apparatus of ink-jet recording apparatuses utilizes a serial scanning system in which horizontal scanning is carried out in a direction perpendicular to the direction of feeding of a recording material (direction of vertical scanning). In this serial type recording apparatus, an image is recorded by recording means loaded on a carriage which is moved in the direction of horizontal scanning along the recording material, the recording material is fed (pitch feeding) for a predetermined length in the direction of vertical scanning after recording is completed for one line, and an image for a next line is then recorded on the stopped recording material. These operations are repeated to record an image over the entire recording material.

On the other hand, in a line type recording apparatus for recording by vertical scanning in the direction of feeding of the recording material, the recording material is set at a predetermined recording position, recording is carried out for one line at a time, the recording material is fed (pitch feeding) for a predetermined length, and recording is then carried out for a next line at a time. These operations are repeated to record an image over the entire recording material. An ink-jet recording apparatus utilizing such line type recording means in which many discharge openings are arranged in the widthwise direction of the recording material enables a further increase in recording speed.

If such an ink-jet recording apparatus is used for textile printing, the screen plates used in screen textile printing need not be used, and thus the numbers of processes and days required to prepare for printing can be significantly decreased. A decrease in size of the apparatus can also be realized.

Even for such an printing apparatus, a increase in printing speed is universally demanded. There have been a proposal of a long head as a construction for increasing the printing speed and many proposals of methods of producing such a long head.

It has been proposed in Japanese Patent Application No. 6-34810 a technology of producing a long head in which substrates (sometimes referred to as "heater boards" hereinafter) each provided with a relatively small number of electro-thermal converters, e.g., 64 or 128 electro-thermal converters, are used as unit substrates, and the heater boards on this unit are precisely arranged and bonded to a base plate. This technology is capable of relatively readily producing a unit substrate having electro-thermal converters arranged with a high precision, and is thus capable of producing a long head at high yield and low cost.

A long head produced by the proposed technology will be described with reference to FIGS. 9 to 14.

FIG. 9 is an exploded perspective view illustrating the construction of a principal portion of such an ink-jet head. The ink-jet head shown in FIG. 9 has 3008 ink discharge openings (printing width 212 mm) with an arrangement density of 360 dpi (discharge opening pitch 70.5 $\mu$m).

Referring to FIG. 9, each of unit substrates ("heater boards" hereinafter) 100 is provided with 128 elements 101 for generating energy utilized for discharging ink with a density of 360 dpi. An electro-thermal converter (referred to as "a heater" hereinafter) for applying heat to an ink is used as each of the elements 101. On the heater boards are provided signal pads 102 for enabling supply of signals from the outside with any desired timing, and electric power pads 401 for supplying electric power.

A plurality of the heater boards 100 having the above-described construction are bonded by an adhesive to a portion of a support (base plate) 300 made of a material such as a metal, ceramic or the like along a side of the support in the lengthwise direction thereof. A driving circuit for selectively driving the heaters 101 in accordance with print data is formed on a control circuit substrate 400 which is bonded to the base plate 300 by an adhesive.

A top plate 200 is joined to a portion of the base plate 300 where the heater boards 100 are arranged, so as to be placed on the heater boards 100. The top plate 200 has grooves for forming ink channels and discharge openings corresponding to the respective heaters 101, and a common liquid chamber groove common to the ink channels, which communicates with the ink channels to supply an ink thereto.

FIG. 10 is a cross-sectional view of the heater boards 100 and the base plate 300 taken along the lengthwise direction thereof.

As shown in FIG. 10, the heater boards 100 are bonded to a predetermined portion of the base plate 300 by an adhesive 301 coated to a predetermined thickness. The heater boards 100 are adjacent to each other with the same pitch as the pitch P=70.5 $\mu$m of the heaters 101 arranged on the heater boards 100. The spaces between the respective heater boards 100 which are produced by the arrangement thereof are sealed with a sealing agent 302 for preventing leakage of ink.

In FIG. 9, the wiring substrate 400 is bonded to the base plate 300 in the same manner as the heater boards 100, as described above, so that the pads 102 provided on the heater boards 100 and the signal/power supply pads 401 provided on the wiring substrate 400 have a predetermined positional relation. On the wiring substrate 400 is provided a connector 402 for supplying print signals and driving power thereto from the outside.

Description will now be made of the top plate 200 serving as a member with grooves which form channels.

Referring to FIG. 11, the top plate 200 comprises the ink channels 202 respectively provided in correspondence with the heaters 101 provided on the heater boards 100, the discharge openings 203 respectively provided corresponding to the ink channels 202 to discharge ink to a printing medium, the liquid chamber channel 202 communicating with the ink channels 201 to supply ink thereto, and ink supply ports 204 for allowing the ink supplied from an ink tank (not shown) to flow in the liquid chamber channel. The top plate 200 has a length substantially corresponding to a row of the heaters formed by the plurality of heater boards 100.

Description will now be made of the process for joining the top plate serving as a channeled member to the supporting member provided with the plurality of heater boards 100.

A base member in which the plurality of heater boards 100 are bonded to the base plate 300 in accordance with predetermined dimensions is first prepared.

As shown in FIG. 12, the base member is placed at the predetermined position on a base 205 provided on a connecting machine (not shown). The base member is positioned by using pins provided on the base 205. The top plate 200 is then set in a hand 206 of the connecting machine. Predetermined positioning of the top plate 200 is performed by the hand 206. The base plate 300 and the top plate 200 are therefore placed on the base 205 and the hand 206, respectively, so that the positional relation therebetween is set within a range. The positions of the base plate 300 and the top plate 200 are then confirmed by a microscope of the connecting machine. Namely, these positions are confirmed by observing that 1504th heater 101 corresponding to the 1504th discharge opening from the direction shown by axis A in FIG. 12. The accurate position of the 1504th heater in the connecting machine is confirmed by image processing as seen from the direction shown by axis A. Similarly, the position of the discharge opening corresponding to the 1504th heater is confirmed by observing from the direction shown by axis B in FIG. 12. The positions of the base plate 300 and the top plate 200 in direction x shown in the drawing are adjusted so that the position of the discharge opening 203 seen from the direction shown by axis B corresponds to the position of the 1504th heater seen from the direction shown by axis A.

Since the connecting machine has a positioning precision of ±2 $\mu$m, positioning in the direction x shown in FIG. 12 can be performed with this precision. The hand 206 is then moved downward in direction z with maintaining the same precision to join the top plate 200 to the heater boards 100. The hand 206 is then removed while the top plate 200 is pressed in the direction shown by axis B (direction y) to fix the top plate 200 by springs (not shown).

Although, in this case, the top plate is mechanically pressed by fixing means such as springs or the like, other various means such as an adhesive, combination of an adhesive and springs, etc. may be used. The top plate 200 and the heater boards 100 are thus bonded with the relation shown in FIG. 13.

The top plate 200 can be produced by any of known methods such as a machining method by cutting, a molding method, an injection method, a photolithographic method, etc.

As described above, an ink-jet head can be obtained by mounting the long top plate (channeled member) on the base member comprising the base plate and the plurality of heater boards, each of which has a plurality of heaters and which are arranged on one side of the base plate, so as to cover the heaters of the plurality of heater boards.

The above-described configuration permits the formation of the ink-jet head having simple ink supply paths, and decreases in the size and cost of the head, as compared with an ink-jet head comprising a plurality of small heads each having a top plate provided on a heater board. Since the plurality of heater boards are arranged on only one side of the base plate, electrical wiring can also be simplified. In addition, since the long top plate is mounted on the base member so as to cover the heaters of the respective heater boards, it is possible to prevent the problem that, in an ink-jet head comprising the small heads arranged therein, the channel directions of the respective heads are not uniform. Particularly, when only one top plate is provided, as described above, the directions of all channels can be made uniform by only one registration, and thus a long head producing no shift in printing can be readily obtained.

The aforementioned configuration enables the realization of a long print head which can be practically used.

However, even in the ink-jet head configured as described above, it is impossible to completely solve the problems with respect to shifts of the adhesion positions of the discharged ink droplets caused by small shifts in arrangement of the heater boards, and the nonuniformity of density due to small differences in the amounts of the inks discharged from respective heater boards. The inventors found that differences in density characteristics between respective heater boards are visually remarkable in the portions printed by inks discharged from discharge openings near the boundaries between the respective heater boards.

SUMMARY OF THE INVENTION

The present invention has been achieved for solving the above problems, and an object of the present invention is to provide an ink-jet printing apparatus which is capable of decreasing the nonuniformity of density in the portions printed by inks discharged from discharge openings near the boundaries between respective heater boards in such a long head as described above, and a print head unit used in the printing apparatus.

In order to achieve the object, in accordance with one aspect of the present invention, there is disclosed an ink-jet printing apparatus comprising a plurality of print heads each having a plurality of unit substrates each of which has a plurality of discharge energy generating elements for generating energy for discharging ink from discharge openings, and which are arranged in the direction of arrangement of the plurality of discharge energy generating elements, so that printing is performed by discharging inks from the plurality of print heads to a printing medium. In the ink-jet printing apparatus, the plurality of print heads are arranged in the direction of arrangement of the discharge energy generating elements with a distance equal to a non-integral multiple of the length of each of the unit substrates in the direction of arrangement thereof.

In accordance with another aspect of the present invention, there is disclosed an ink-jet printing apparatus comprising a plurality of print heads each having a plurality of unit substrates each of which has a plurality of discharge energy generating elements for generating energy for discharging ink from discharge openings, and which are arranged in the direction of arrangement of the plurality of discharge energy generating elements, so that printing is performed by discharging inks from the plurality of print heads to a printing medium. The ink-jet printing apparatus further comprises relative scanning means for scanning the printing medium relatively to the print heads, wherein the amount of scanning of the printing medium by the relative scanning means relative to the print heads is a non-integral multiple of the length of each of the unit substrates in the direction of arrangement of the discharge energy generating elements.

In accordance with a further aspect of the present invention, there is disclosed a print head unit comprising a plurality of print heads each having a plurality of unit areas each of which has a plurality of discharge energy generating elements for generating energy for discharging ink from discharge openings and which are arranged so as to be thermally isolated from each other, so that printing is performed by discharging inks from the plurality of print heads to a printing medium. The print head unit further comprises relative scanning means for scanning the printing medium relatively to the print heads, and control means for controlling the amount of relative scanning by the relative scanning means so that portions of the printing medium which respectively correspond to the boundaries between the respective unit areas do not overlap one another.

The above-described construction can prevent overlap of portions respectively corresponding to the boundaries between the respective unit substrates, thereby decreasing the nonuniformity of density in portions near the boundaries in each of the print heads.

DESCRIPTION OF THE PREFERRED EMBODIMENTS

Embodiments of the present invention will be described with reference to the drawings.

(First Embodiment)

Figure 14:
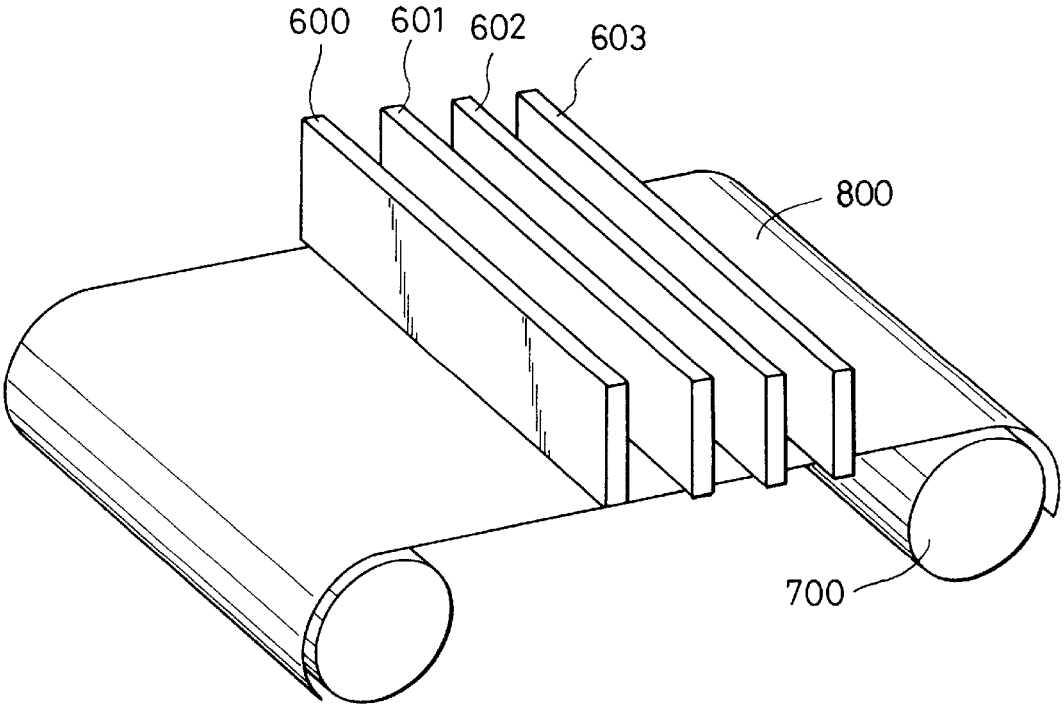
FIG. 14 is a perspective view illustrating the arrangement of print heads in accordance with a further embodiment of the present invention.

FIG. 14 is a schematic perspective view illustrating the configuration of a principal portion of an ink-jet printing apparatus in accordance with an embodiment of the present invention. The apparatus shown in FIG. 14 comprises full-line type ink-jet print heads each having discharge openings which are disposed with a length corresponding to the width of a printing medium. The above-described long head is used as each of the print heads.

In FIG. 14, reference numerals 600, 601, 602 and 603 denote full line ink-jet print heads for cyan (C), magenta (M), yellow (Y) and black (Bk), respectively. Printing is performed by discharging inks from the ink-jet print heads to a printing medium 800 such as paper, cloth or the like which is fed by a feeding roller 700.

Figure 1:
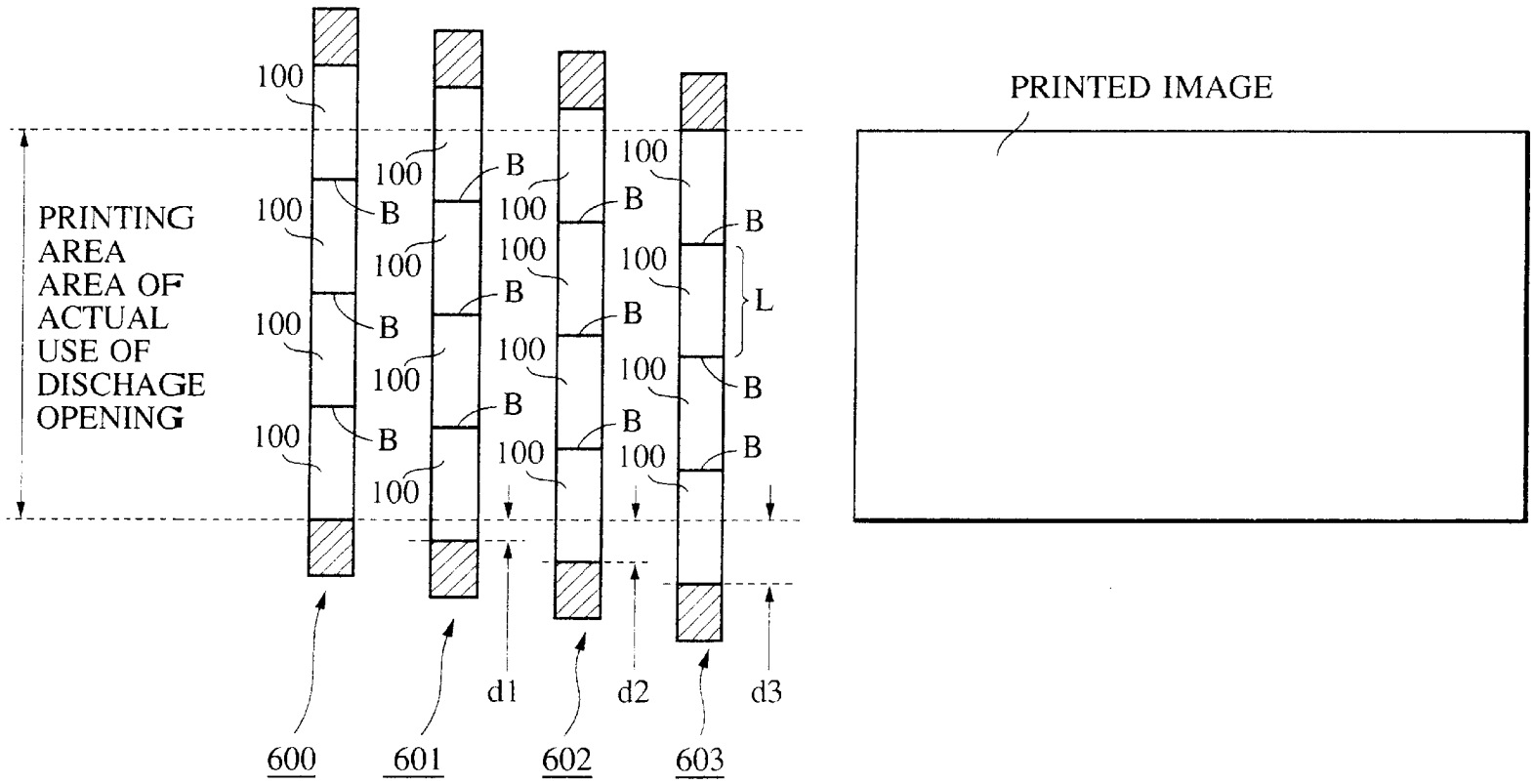
FIG. 1 is a drawing illustrating the positional relation among print heads in accordance with an embodiment of the present invention.

FIG. 1 is a drawing illustrating the positional relation among the print heads in the apparatus.

In FIG. 1, each of the ink-jet print heads 600 to 603 has a plurality of heater boards 100 (unit substrates; in the drawing, only four substrates are shown in each of the heads for the sake of simplicity of description) with boundaries B between the respective heater boards 100. The print heads are disposed in such a manner that the print heads 601 to 603 are shifted from the print head 600 for cyan ink by a length which increases in increments of ⅕ of the length L of each heater board 100, i.e., shifted by $d_1$=0.2L, $d_2$=0.4L and $d_3$=0.6L, respectively. The print heads are therefore provided in the apparatus so that the positions of the boundaries B between the respective heater boards in one of the print heads do not correspond to the positions in other print heads. As a result, in a printing area of each of the print heads corresponding to the size of a printed image, i.e., an area where the discharge openings are actually used, the boundaries B in one of the print heads are shifted from those in other print heads.

Figures 2A, 2B:
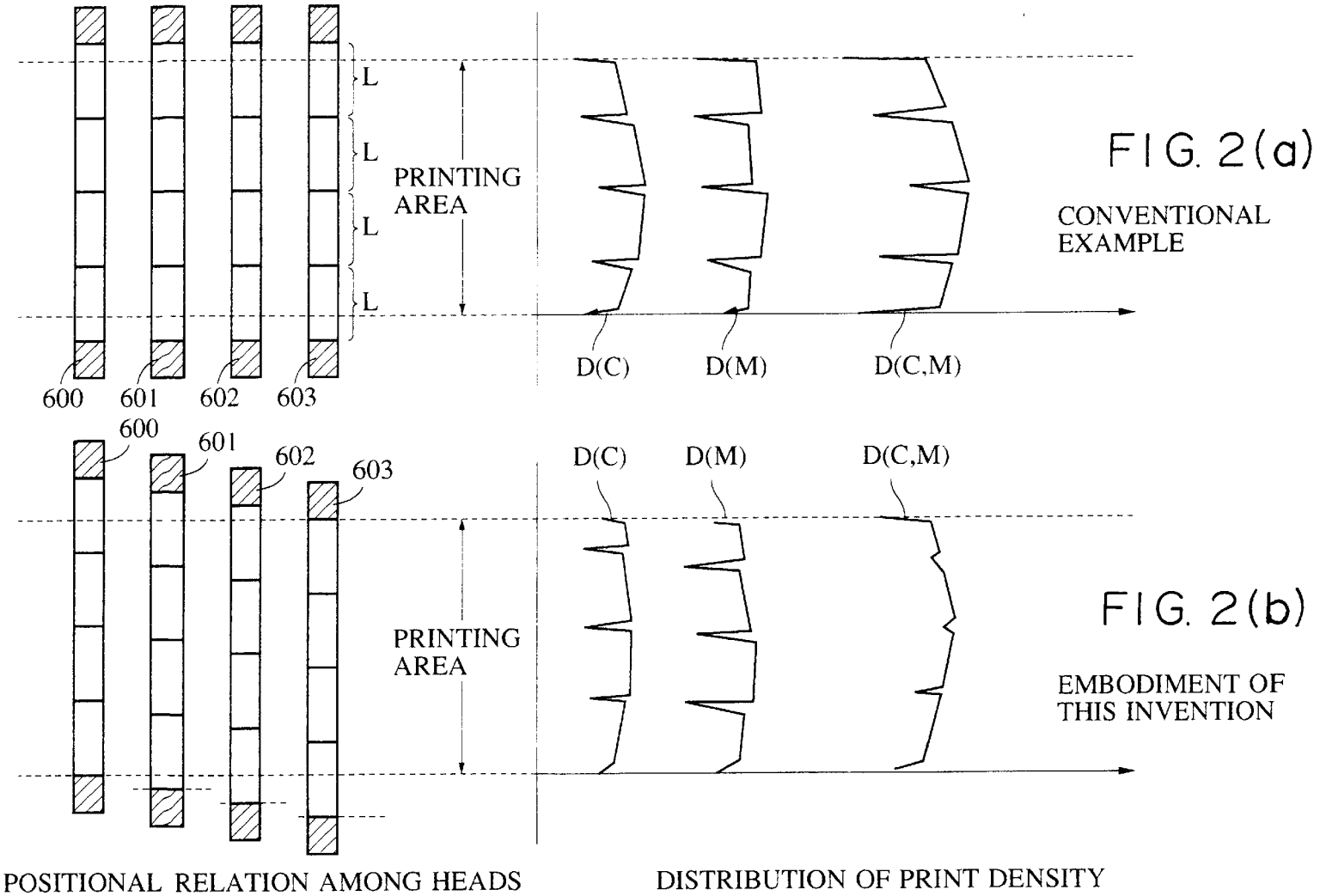
FIG. 2*a* and FIG. 2*b* are drawings illustrating the effects of the embodiment shown in FIG. 1.

FIGS. 2(*a*) and (*b*) are drawings illustrating the relations between the positional relations among heads and the print density distributions (50% half-tone for each color, measured by a microdensitometer) in a conventional example and this embodiment, respectively.

In both the conventional example and this embodiment shown in FIG. 2, each pixel is formed with the inks of cyan (C) and magenta (M) discharged from the print heads 600 and 601, respectively, and the density distribution of a 50% half-tone printed image is shown. If the density distributions of images printed by the print heads 600 and 601 are D(C) and D(M), respectively, the density distribution of an image printed by mixing cyan and magenta colors is shown by D(C, M).

As seen from FIG. 2, in the density distribution D(C, M) in the conventional example, the feature of the density distribution in each of the heads is emphasized at the boundaries between the respective heater boards, thereby increasing the density differences between the boundaries and other portions. On the other hand, in this embodiment, the density differences at the boundaries between the print heads are canceled, thereby decreasing the density differences at the boundaries in the density distribution D(C, M).

In order to realize such a density distribution in this embodiment, the print heads have the positional relation in which if one of the heads is considered as a reference, and the positional shift of each of the other heads from the reference is shown by d, $d \neq nL$ (n: integer, L: the length of each heater board 100).

(Second Embodiment)

Description will now be made of another embodiment of the present invention in which the present invention is applied to the case where overlap printing is carried out by using a plurality of head stations each comprising a plurality of heads, as shown in the first embodiment.

Figure 3:
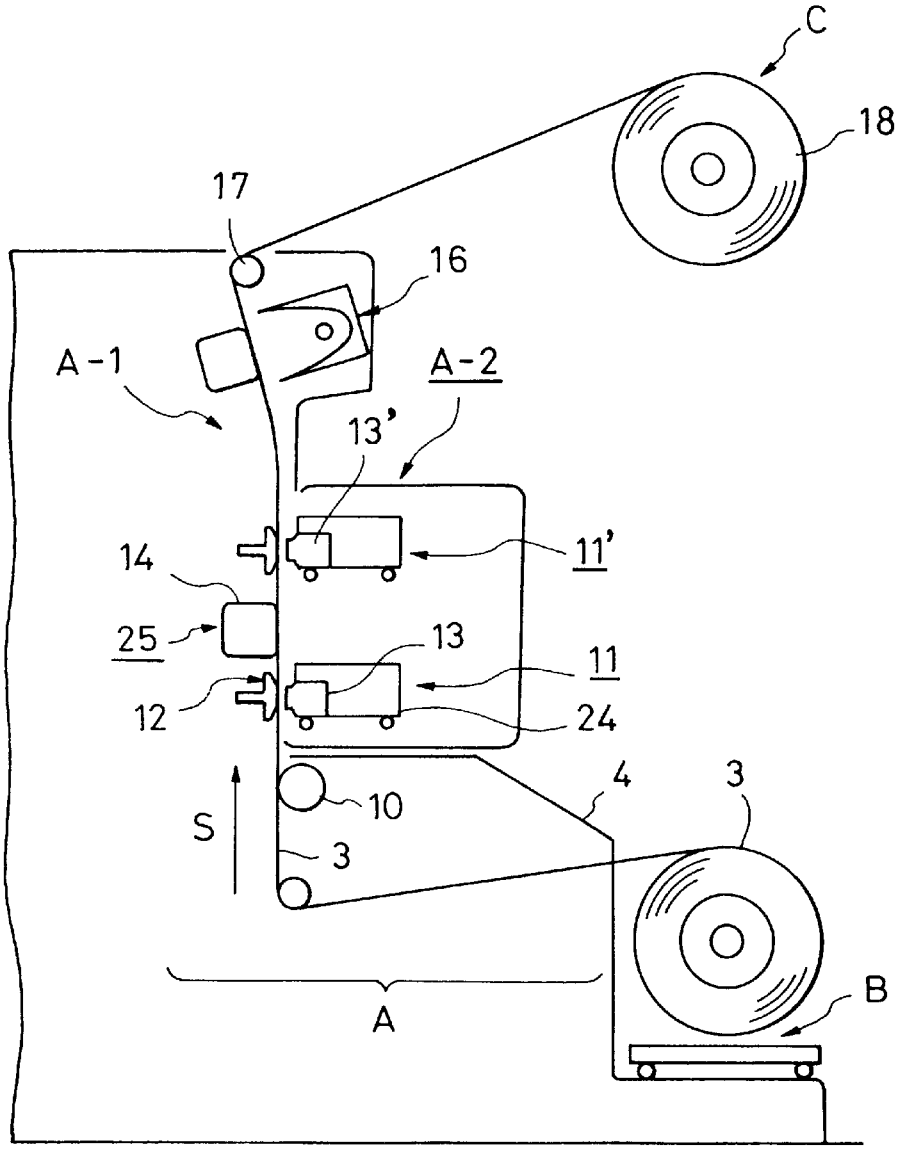
FIG. 3 is schematic side view illustrating a textile printing apparatus in accordance with another embodiment of the present invention.

FIG. 3 is a side view of a textile printing apparatus serving as an ink-jet printing apparatus in accordance with this embodiment.

As shown in FIG. 3, the textile printing apparatus of this embodiment roughly comprises cloth feeding unit B for feeding roll cloth which was subjected to pretreatment for printing, body unit A for printing on the fed cloth by ink-jet heads while precisely spacing lines, and winding unit C for drying and winding the printed cloth. The body unit A further comprises precise feeding unit A-1, which includes platens, and printing unit A-2.

The roll cloth which was subjected to pretreatment is stepwisely fed from the cloth feeding unit 3 to body unit A in the direction shown by arrow S.

In a first printing section 11, the flat recording surface of the cloth 3 fed stepwisely is maintained by a platen 12, and printing is carried out on the surface of the cloth 3 by a group of ink-jet heads 13. The cloth is stepwisely fed at each time printing for one line is completed. In a second printing section 11', printing is performed on the image printed by the first printing section 11 by the same method as that employed in the first printing unit 11 using a group of ink-jet heads 13'.

Figure 4:
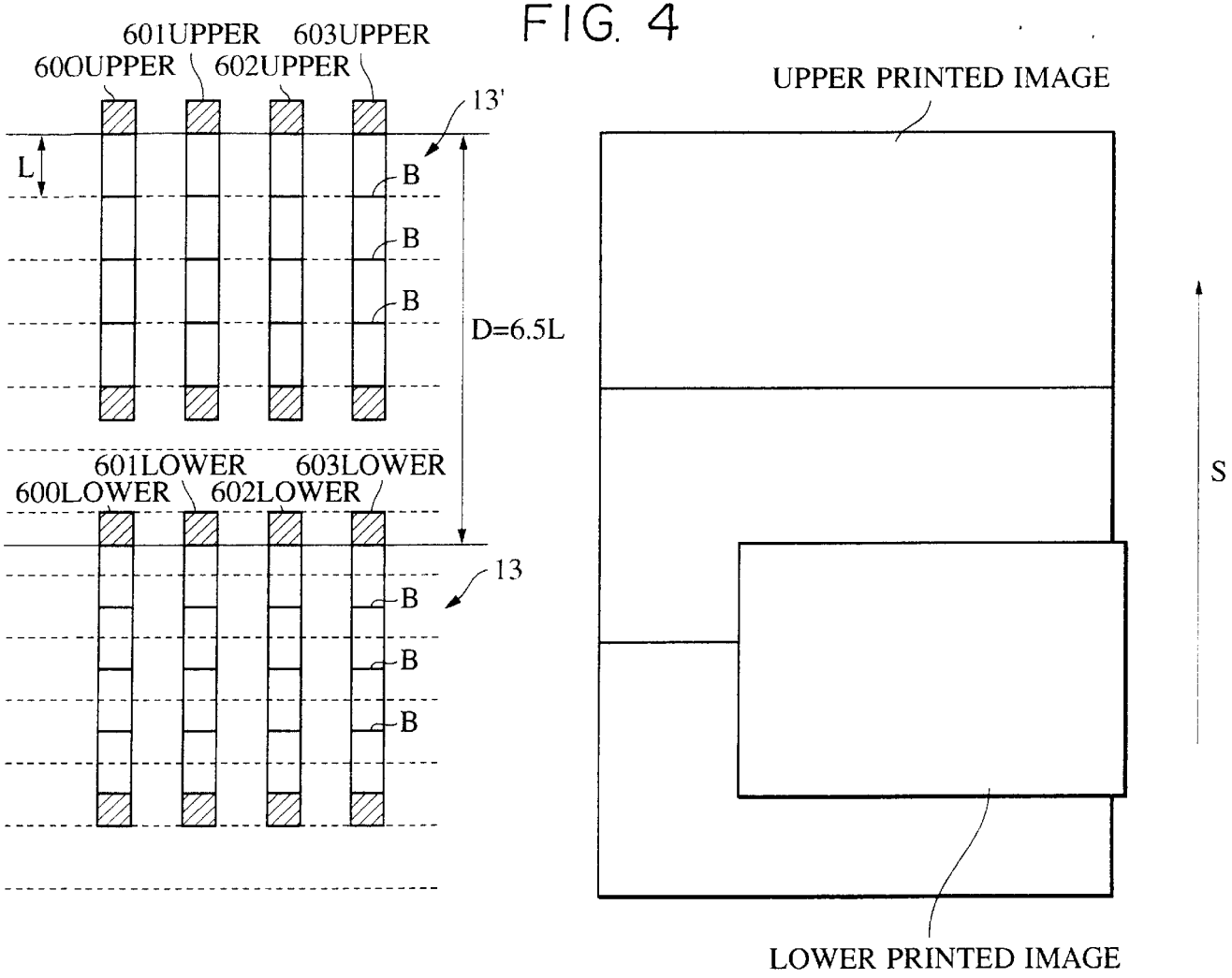
FIG. 4 is a drawing illustrating the positional relation among print heads in the apparatus shown in FIG. 3.

FIG. 4 shows an example of the positional relation between the upper group of print heads 13' and the lower group of print heads 13 in the above-described configuration.

In this embodiment, in feeding of the cloth 3, the head group 13' and the head group 13 are disposed so that the positions of the boundaries (shown by broken lines in FIG. 4) between respective heat boards in the upper head group 13' respectively correspond to the centers of the respective heater boards in the lower head group 13.

If the distance between the head groups is D, such a positional relation between the upper and lower head groups is expressed by the following equation:

$$D=6.5L=(0.5+6)\times L$$

Such arrangement permits printing in the portions near the boundaries between the respective heater boards where the most significant density changes are overlapped by the central portions where densities are most stable, and the effect of decreasing the nonuniformity of density can thus be increased.

Figure 5:
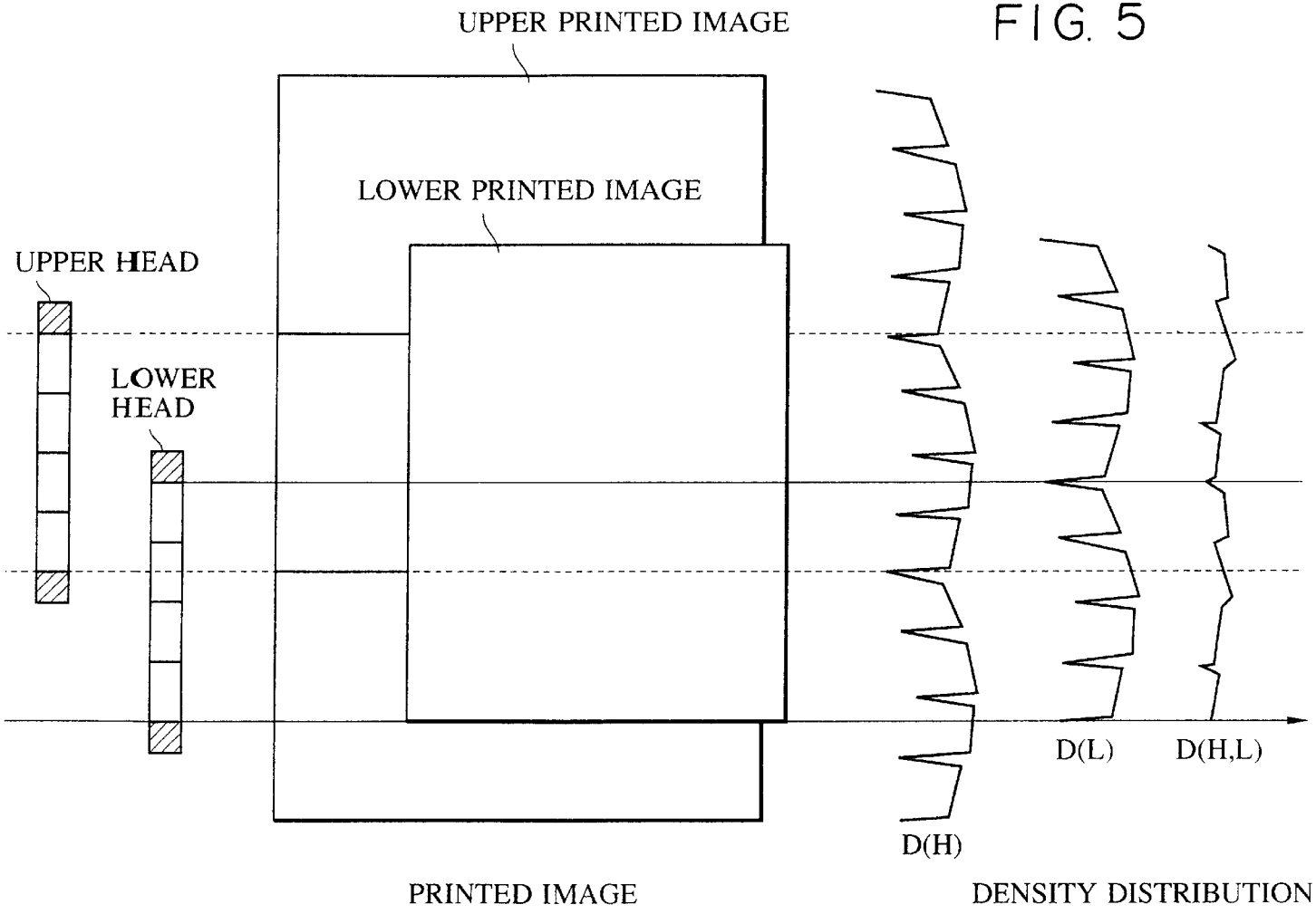
FIG. 5 is a drawing illustrating the effect of the positional relation shown in FIG. 4.

FIG. 5 shows the density distribution in such overlap printing. The density distribution of an image printed by the upper head is shown by D(H), and the density distribution of an image printed by the lower head is shown by D(L).

The upper head and the lower head shown in FIG. 5 overlap each other in the direction of feeding of the cloth for the sake of simplifying the explanation of how the image printed by the upper head and the image printed by the lower head are overlapped on the printing medium.

As shown in FIG. 5, in the density distribution D(H, L) of an overlap image printed by the upper and lower heads, the density differences in portions corresponding to the boundaries between the respective heater boards are decreased, thereby causing uniformity of density.

The overlap printing includes printing in which complementary dot recording is performed by upper and lower heads, and simple overlap printing in which a plurality of dots are formed at the same position.

The head relation in this embodiment is represented by $D \neq nL$ (n: integer).

(Third Embodiment)

Figure 6:
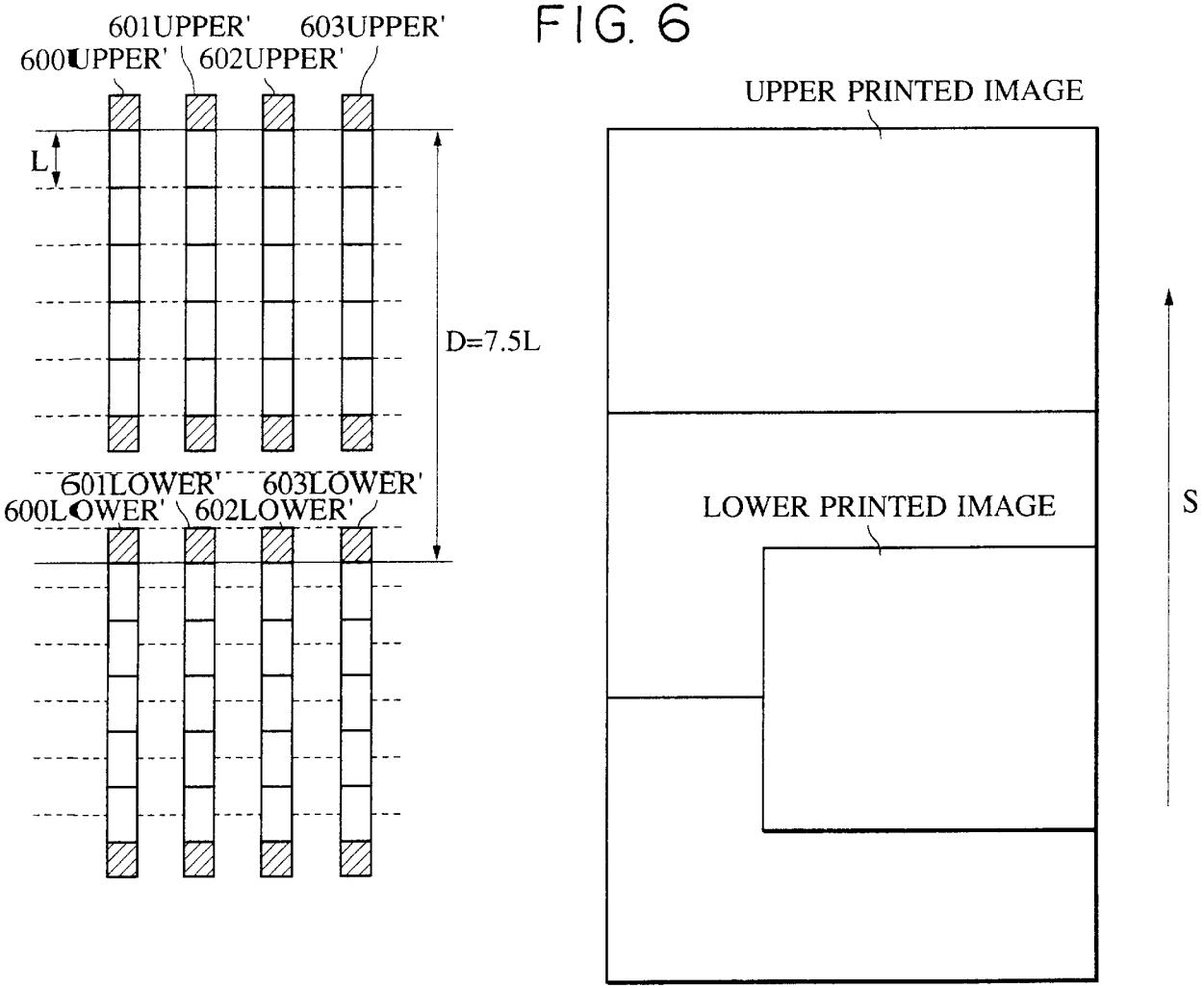
FIG. 6 is a drawing illustrating the positional relation among print heads in accordance with still another embodiment of the present invention.

FIG. 6 is a drawing illustrating a head positional relation in accordance with a further embodiment of the present invention. This embodiment uses the same apparatus as that used in the second embodiment except that each of recording heads comprises a group of printing elements each of which has an odd number m of heater boards.

The positional relation between the head groups in this construction is represented by the following equation:

$$D=7.5L=(0.5+7)L=5/2L+5L=(\text{length corresponding to half of a head})+(\text{length corresponding to one head})$$

Figure 7:
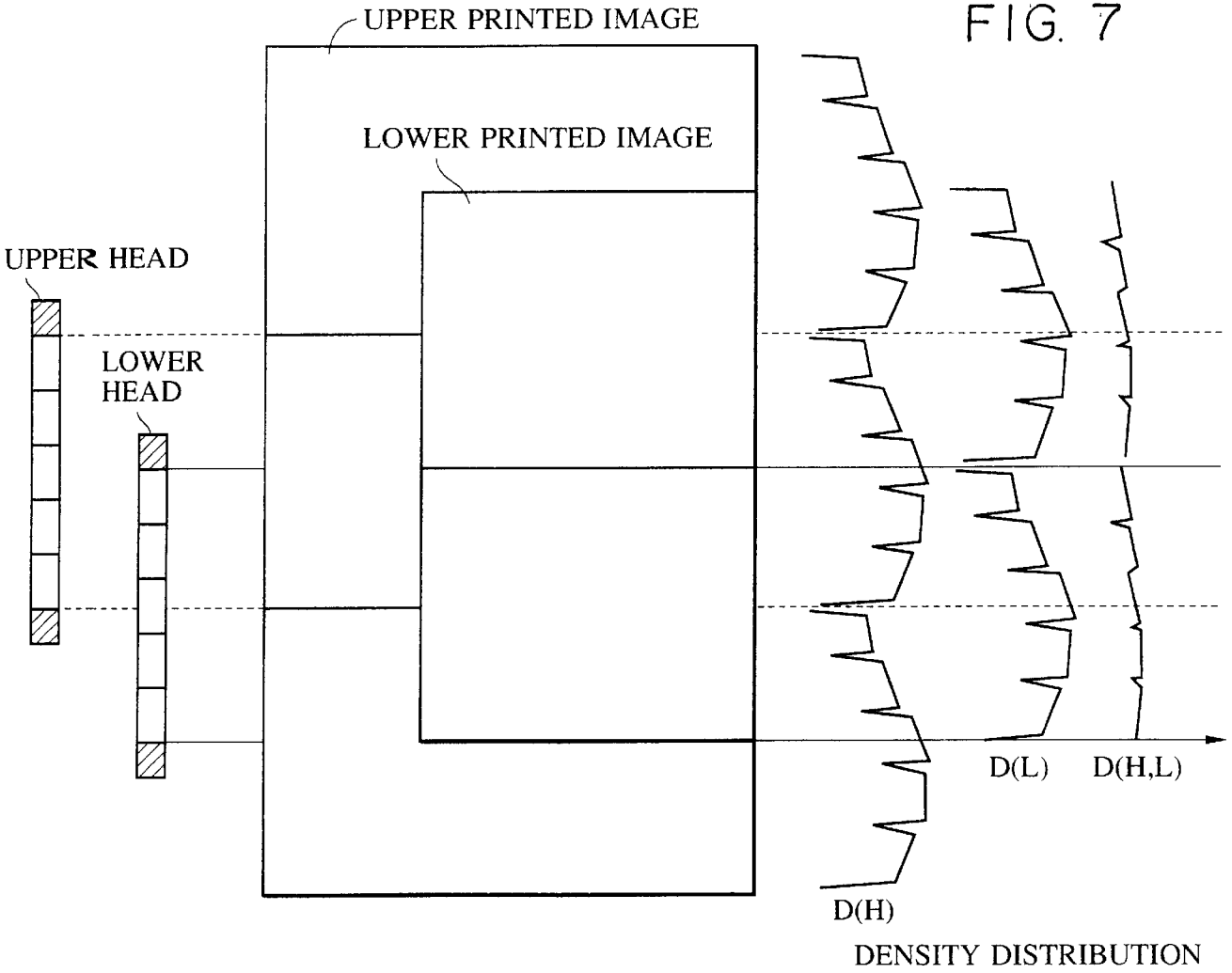
FIG. 7 is a drawing illustrating the effect by the positional relation among print heads shown in FIG. 6.

Since the center of one of the upper and lower head groups corresponds to an end of the other group, as shown in FIG. 7, the overall density distribution of the heads is substantially completely uniform. However, when print heads which employ thermal energy are used, as in this embodiment, the density of a central portion is generally higher because the central portion easily accumulates heat.

Like in FIG. 5, the upper head and the lower head shown in FIG. 7 also overlap each other in the direction S of feeding of a printing medium for the sake of simplifying the explanation of how the image printed by the upper head and the image printed by the lower head are overlapped.

In general, the following relation is established:

$$D=(0.5+n)L=mL/2+mL\times a$$

n: integer, m: odd number, a: integer of 0 or more.

The print heads having the positional relation shown in each of the first to third embodiments can be used as a unit with the fixed positional relation, or detachably mounted as a unit to an apparatus.

(Fourth Embodiment)

Figures 8A, 8B, 8C:
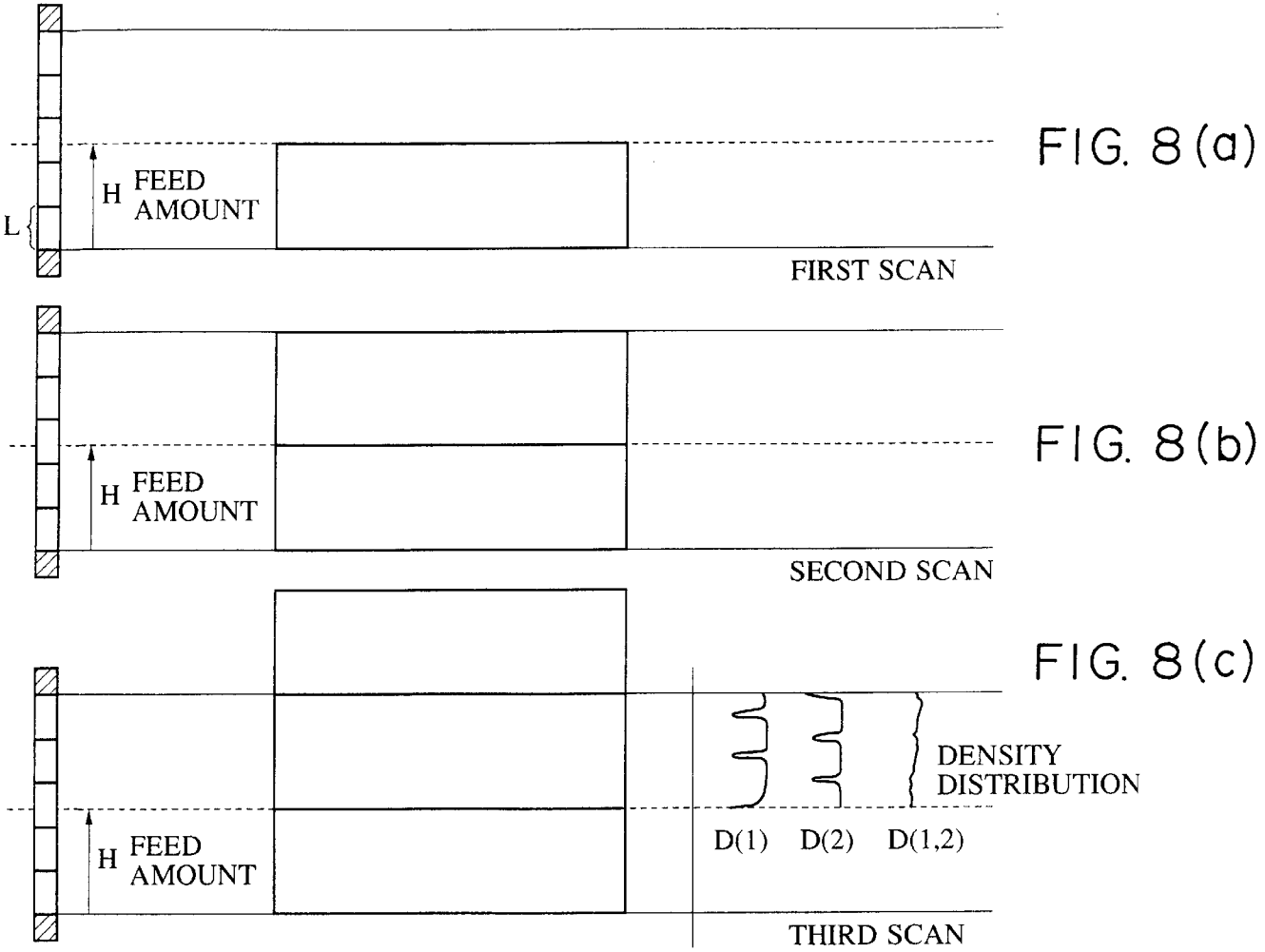
FIGS. 8*a*, 8*b* and 8*c* are drawings illustrating a printing method in accordance with a further embodiment of the present invention.
Figure 9:
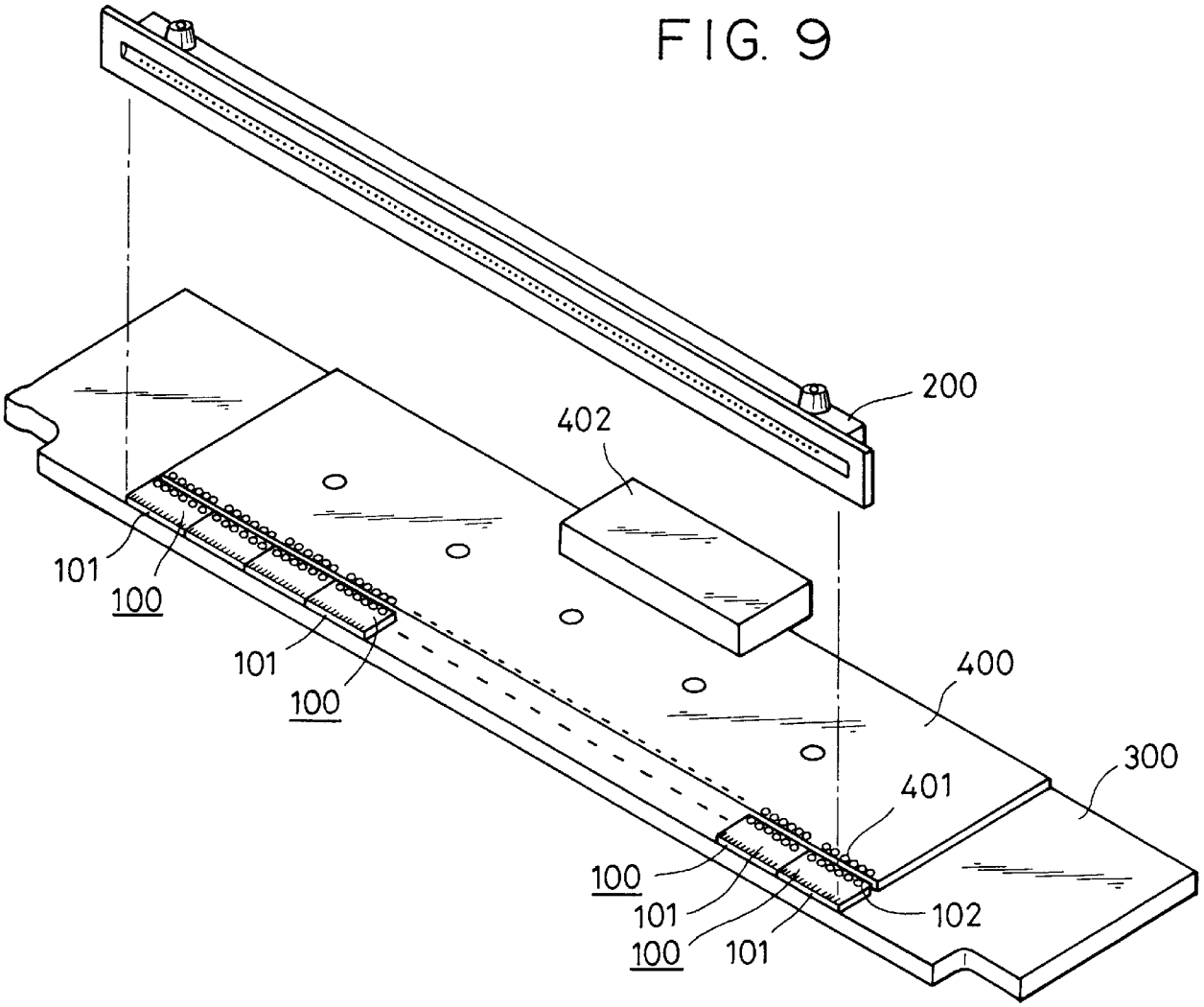
FIG. 9 is an exploded perspective view illustrating a long print head used in an embodiment of the present invention.
Figure 10:
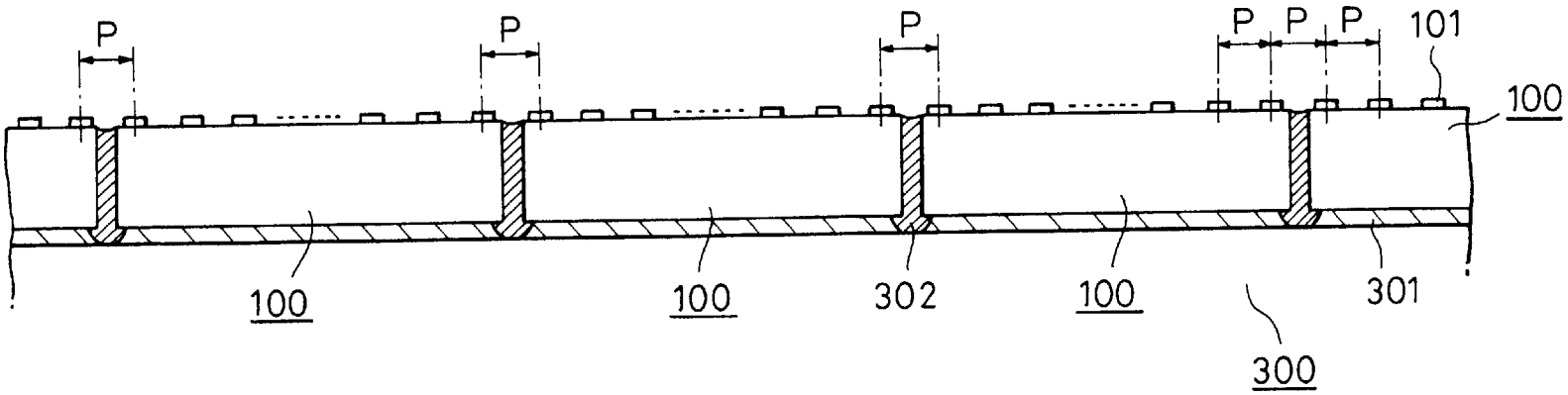
FIG. 10 is a cross-sectional view illustrating the print head shown in FIG. 9.

FIGS. 8(*a*) to (*c*) are drawings illustrating a still further embodiment of the present invention.

In this embodiment, as shown in FIGS. 8(*a*) to (*c*), the printing medium is fed in a feed amount significantly smaller than the width of a print head so that the same pixel is printed by a plurality of scans.

In this embodiment, the length L of a heater board and the feed amount H may have the relation, $H \neq nL$ (n: integer) wherein H=2.5L.

This configuration can make uniform the density distribution D(1, 2) of an image printed by two scans, thereby decreasing nonuniformity of density, as shown in FIG. 8.

Although this embodiment uses a single print head, when a plurality of print heads are arranged, the same effect as described above can of course be obtained.

As is obvious from the above description, in the present invention, portions in a printed image which correspond to the boundaries between respective unit substrates are not overlapped, thereby preventing increases in the nonuniformity of density at the boundaries which are due to changes in characteristics of the energy generating elements near the boundaries in each of the print heads.

As a result, an image in which nonuniformity of the density is decreased can be obtained.

(Others)

Particularly, the present invention exhibits excellent effects on a print head in a bubble jet system of ink-jet printing systems, which utilizes thermal energy for forming and scattering droplets to print an image, and which is advanced by Canon, Inc.

It is preferable to use the basic principle disclosed in, for example, U.S. Pat. Nos. 4,723,129 and 4,740,796. This system can be applied to a so-called on-demand type or continuous type apparatus. In particular, the on-demand type is effective because heat energy is generated in an electro-thermal converter which is disposed opposite to a sheet containing a liquid (ink) and liquid passage by applying, to the electro-thermal converter, at least one driving signal for rapidly increasing the temperature above the temperature of nucleate boiling in correspondence with recording information to produce film boiling in the thermal action surface of the recording head. As a result, bubbles are formed in the liquid (ink) in one-to-one correspondence with the driving signal. The liquid (ink) is discharged from a discharge opening due to the growth and contraction of the bubble to form at least one droplet. The driving signal in a pulse form is more preferable because the bubble is instantaneously and appropriately grown and contracted, thereby achieving discharge of the liquid (ink) with excellent responsiveness. The driving signals disclosed in U.S. Pat. Nos. 4,463,359 and 4,345,262 are suitable as such pulse-formed driving signals. More excellent recording can be performed by employing the conditions disclosed in the invention of U.S. Pat. No. 4,313,124 which relates to the rate of temperature rise of the thermal action surface.

The present invention includes not only the structure of the recording head comprising the combination of a discharge opening, a liquid passage (a linear liquid passage or a right angle liquid passage) and an electro-thermal converter, as disclosed in each of the above specifications, but also the structures disclosed in U.S. Pat. Nos. 4,558,333 and 4,459,600 in which a thermal action portion is disposed in a bent region. The present invention is also effective for structures based on the structure disclosed in Japanese Patent Laid-Open No. 59-123670 in which a common slit is provided as a discharge portion for a plurality of electro-thermal converters, and the structure disclosed in Japanese Patent Laid-Open No. 59-138461 in which an opening for absorbing the pressure wave of thermal energy is provided opposite to a discharge portion.

Further, the present invention can effectively be applied to a full-line type recording head having a length corresponding to the maximum width of recording media on which the recording apparatus can record images. Such a recording head may comprise a combination of a plurality of recording heads which satisfy the length of the recording head, or a single recording head which is integrally formed.

The present invention is also effective for the use of an exchangeable chip type recording head which permits electrical connected to the apparatus body and supply of ink from the apparatus body when being mounted thereon, or a cartridge type recording head having an ink tank which is provided integrally with the recording head.

It is also preferable to add as components discharge recovery means for the recording head, preliminary auxiliary means and the like to the recording apparatus of the present invention because the effects of the invention can further be stabilized. Examples of such means for performing stable discharge include capping means for the recording head, cleaning means, pressure or suction means, preheating means for heating by using an electro-thermal converter or another heating element or a combination thereof, and pre-discharge means for discharging ink separately from recording.

Further, the present invention is significantly effective for not only a recording apparatus having a recording mode only for a main color such as black or the like but also a recording apparatus having at least one of full-color recording modes for a plurality of different colors and color mixture whether the apparatus comprises an integral recording head or combination of a plurality of heads.

In either case, the use of an ink-jet textile printing system for expressing an image in a dot pattern by using digital image processing eliminates the need for continuous cloth which is used in a conventional textile printing method of repeatedly printing the same pattern thereon. Namely, it is possible to print patterns necessary for producing various kinds of clothing adjacent to each other on the same continuous cloth in consideration of the sizes and outer shapes thereof and minimize portions of the cloth which are not used after cutting.

Namely, it is possible to print patterns used for completely different kinds of clothing on the same cloth and then cut the cloth. This cannot be achieved by a conventional textile printing method.

When different patterns for clothing having different sizes, different scheduled numbers of articles, types (designs) and so on are printed adjacent to each other on the same cloth, cutting lines and sewing lines can be drawn by using the same textile printing system, thereby increasing the efficiency of production.

Since the cutting lines and sewing lines can be drawn by digital image processing, they can be drawn effectively according to schedule, and patterns can readily be matched at sewing. In a data processing device, in consideration of patterns, the directions of cutting can be set to the direction of texture or a bias direction throughout cloth in accordance with the types and designs to form a layout on the cloth.

The cutting lines and sewing lines can also be drawn by using a dye which can be removed by washing after production of clothing, unlike dyes of textile printing inks.

In addition, it is unnecessary to adhere ink to a portion of original cloth, which is not required for finishing clothing, so that the ink can effectively be consumed.

Inks which are preferably used in the present invention can be prepared as described below.

| | |
|---|---|
| (1) Reactive dye (C. I. Reactive Yellow 95) | 10 parts by weight |
| Thiodiglycol | 10 parts by weight |
| Diethylene glycol | 20 parts by weight |
| Water | 60 parts by weight |

The above components were mixed, and agitated for 1 hour, and pH is adjusted to 7 with NaOH, followed by agitation for 2 hours. The resultant mixture was filtered with Fluoro Porefilter FP-100 (trade name, produced by Sumitomo Denko Co., Ltd.) to obtain an ink.

| | |
|---|---|
| (2) Reactive dye (C. I. Reactive Red 24) | 10 parts by weight |
| Thiodiglycol | 15 parts by weight |
| Diethylene glycol | 10 parts by weight |
| Water | 60 parts by weight |

An ink was prepared by the same method as described above in ink (1).

| | |
|---|---|
| (3) Reactive dye (C. I. Reactive Blue 72) | 8 parts by weight |
| Thiodiglycol | 25 parts by weight |
| Water | 67 parts by weight |

An ink was prepared by the same method as described above in ink (1).

| | |
|---|---|
| (4) Reactive dye (C. I. Reactive Blue 49) | 12 parts by weiqht |
| Thiodiglycol | 25 parts by weight |
| Water | 63 parts by weight |

An ink was prepared by-the same method as described above in ink (1).

| | |
|---|---|
| (5) Reactive dyes (C. I. Reactive Black 39) | 10 parts by weight |
| Thiodiglycol | 15 parts by weight |
| Diethylene glycol | 15 parts by weight |
| Water | 60 parts by weight |

An ink was prepared by the same method as described above in ink (1).

As described above, in the present invention, when an ink is discharged from a print head and adhered to a printing medium such as cloth or the like to form an image by many ink dots, the amount of the ink discharged from the print head to the printing medium is appropriately set so that the ratio of coverage per dot before fixing is less than 100%, and the average diameter of equivalent dot circles after fixing is not more than ¾ of the average diameter of fibers which constitute cloth. It is thus possible to decrease bleeding at boundaries between the respective fibers which overlap one another, and consequently form dots having high graininess, thereby obtaining the effect of enabling the formation of an ink-jet printed image having excellent quality.

What is claimed is:

1. An ink-jet printing apparatus utilizing a plurality of print heads each comprising a plurality of unit substrates each of which has a plurality of discharge energy generating elements for generating energy for discharging an ink from discharge openings, said plurality of unit substrates being arranged in a direction of arrangement of said plurality of discharge energy generating elements, so that printing is performed by discharging the ink from said plurality of print heads to a printing medium, said apparatus comprising:

a mounting unit for mounting said plurality of print heads, wherein said plurality of print heads are mountable on said mounting unit in the direction of arrangement of said discharge energy generating elements with a spacing distance between adjacent print heads being equal to a non-integer multiple of a length of each of said unit substrates in the direction of arrangement thereof.

2. An ink-jet printing apparatus according to claim 1, wherein said plurality of said print heads mounted on said mounting unit are disposed in a direction of feeding of the printing medium, and the spacing distance is in the direction of feeding.

3. An ink-jet printing apparatus according to claim 1, wherein said plurality of said print heads mounted on said mounting unit are disposed in a direction perpendicular to a direction of feeding of the printing medium, and the spacing distance is in the direction of feeding.

4. An ink-jet printing apparatus according to claim 1, wherein if the spacing distance is d, and the length of each of said substrate units in the direction of arrangement is L, the following relation is obtained:

$d=(0.5+n)\times L$, where n is an integer.

5. An ink-jet printing apparatus according to claim 1, further comprising the plurality of print heads, wherein each of said discharge energy generating elements comprises an electro-thermal converter for applying thermal energy to the ink.

6. An ink-jet printing apparatus comprising:

a print head comprising a plurality of unit substrates each of which has a plurality of discharge energy generating elements for generating energy for discharging an ink from discharge openings, said plurality of unit substrates being arranged continuously in a direction of arrangement of said plurality of discharge energy generating elements, so that printing is performed by discharging the ink from said print head to a printing medium; and relative scanning means for scanning the printing medium relatively to said print head;

wherein an amount of scanning of the printing medium relative to said print head by said relative scanning means is a non-integer multiple of a length of each of said unit substrates in the direction of arrangement of said discharge energy generating elements.

7. An ink-jet printing apparatus according to claim 6, wherein each of said discharge energy generating elements comprises an electro-thermal converter for applying thermal energy to the ink.

8. An ink jet printing apparatus according to claim 6, further comprising:

main scanning means for scanning said print head relatively to the printing medium in a direction substantially perpendicular to the direction of arrangement of said plurality of discharge energy generating elements; and print control means for performing printing by discharging the ink from said print head during scanning of said print head by said main scanning means.

9. An ink jet printing apparatus according to claim 8, wherein said print control means performs printing by repeatedly executing scanning of said print head by said main scanning means and relative scanning of the printing medium by said relative scanning means.

10. An ink jet printing apparatus according to claim 8, wherein an area on which printing is performed by a previous scanning by said main scanning means and an area on which printing is performed by a following scanning overlap at least partially.

11. An ink jet printing apparatus according to claim 6, further comprising at least one additional print head.

12. An ink-jet printing unit comprising:

a print head having a plurality of unit areas in each of which a plurality of discharge energy generating elements for generating energy for discharging an ink from discharge openings are arranged, said unit areas having boundaries therebetween and being arranged continuously so that printing is performed by discharging an ink to a printing medium from said print head;

relative scanning means for scanning said printing medium relatively to said print head; and control means for controlling an amount of relative scanning by said relative scanning means so that portions of the printing medium which respectively correspond to the boundaries between said respective unit areas are not overlapped.

13. An ink-jet printing unit according to claim 12, wherein each of said discharge energy generating elements comprises an electro-thermal converter for applying thermal energy to the ink.

14. An ink jet printing unit according to claim 12, wherein said unit areas of said print head are thermally isolated.

15. An ink jet printing method, using a print head comprising a plurality of unit substrates each of which has a plurality of discharge energy generating elements for generating energy for discharging an ink from discharge openings, the plurality of unit substrates being arranged continuously in a direction of arrangement of the plurality of discharge energy generating elements for performing printing by discharging the ink from the print head to a printing medium, said method comprising the steps of:

scanning the print head in a direction substantially perpendicular to the direction of arrangement of the plurality of discharge energy generating elements and performing printing by discharging the ink from the print head during the scanning; and sub-scanning the printing medium relatively to the print head, wherein an amount of sub-scanning the printing medium relatively to the print head is a non-integer multiple of a length of each of the unit substrates in the direction of arrangement of the discharge energy generating elements, and printing on the printing medium is performed by repeatedly executing said scanning step and said sub-scanning step.

16. An ink jet printing method according to claim 15, wherein an area on which printing is performed in a previous scanning step and an area on which printing is performed in a following scanning step overlap at least partially.

17. An ink jet printing method according to claim 15, wherein each of the discharge energy generating elements comprises an electro-thermal converter for applying thermal energy to the ink.

* * * * *

UNITED STATES PATENT AND TRADEMARK OFFICE

CERTIFICATE OF CORRECTION

PATENT NO. : 5,980,020

DATED : November 9, 1999

INVENTOR(S) : YASUSHI MIURA ET AL.

It is certified that error appears in the above-identified patent and that said Letters Patent is hereby corrected as shown below:

ON THE TITLE PAGE:

Item [56] References Cited:

U.S. PATENT DOCUMENTS, "4,410,991" should read --4,401,991--.

Sheet 1 of the Drawings:

Figure 1, "DISCHAGE" should read --DISCHARGE--.

COLUMN 2:

Line 22, "an" should read --a-- and "a" should read --an--.

COLUMN 3:

Line 55, "1504th" should read --the 1504th--.

COLUMN 4:

Line 27, "in" should be deleted.

Figure 11A:
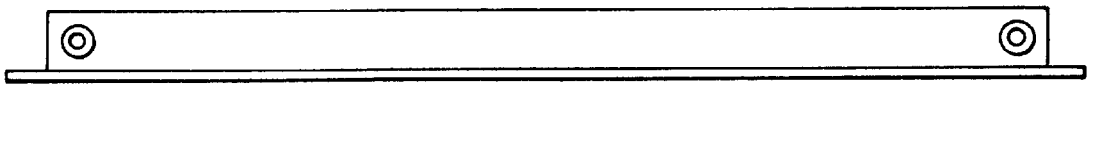
FIG. 11(*a*), (*b*) and (*c*) are a top view, a front view and a bottom view, respectively, illustrating a top plate of the head shown in FIG. 9, and FIG. 11(*d*) is a cross-sectional view along line X—X of FIG. 11(*b*)
Figure 11B:
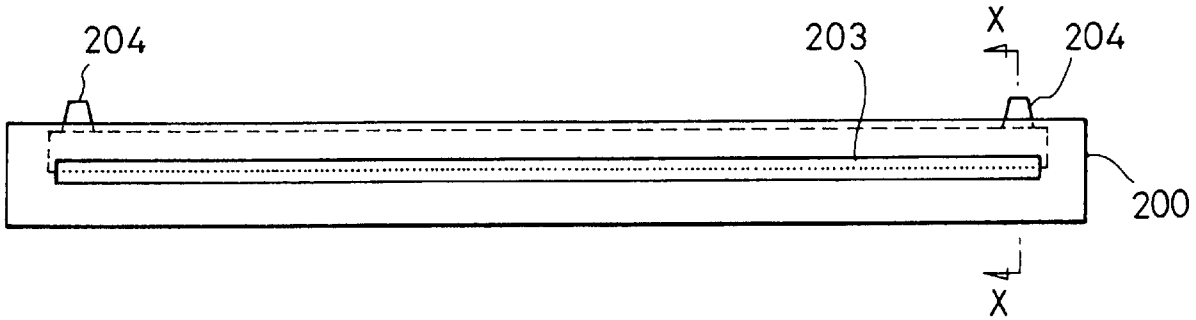
Figure 11C:
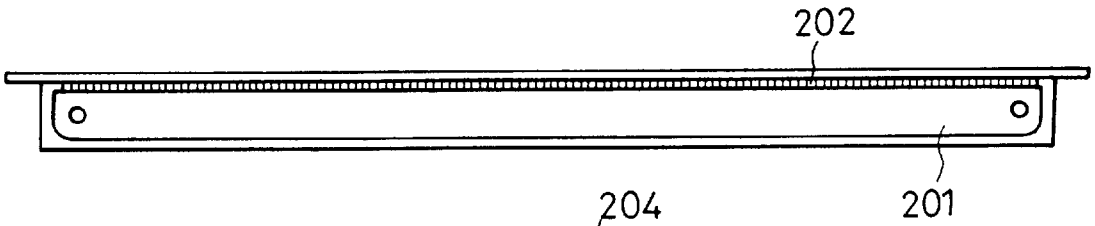
Figure 11D:
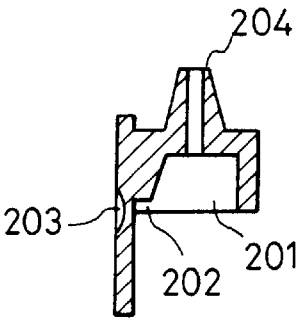
Figure 12:
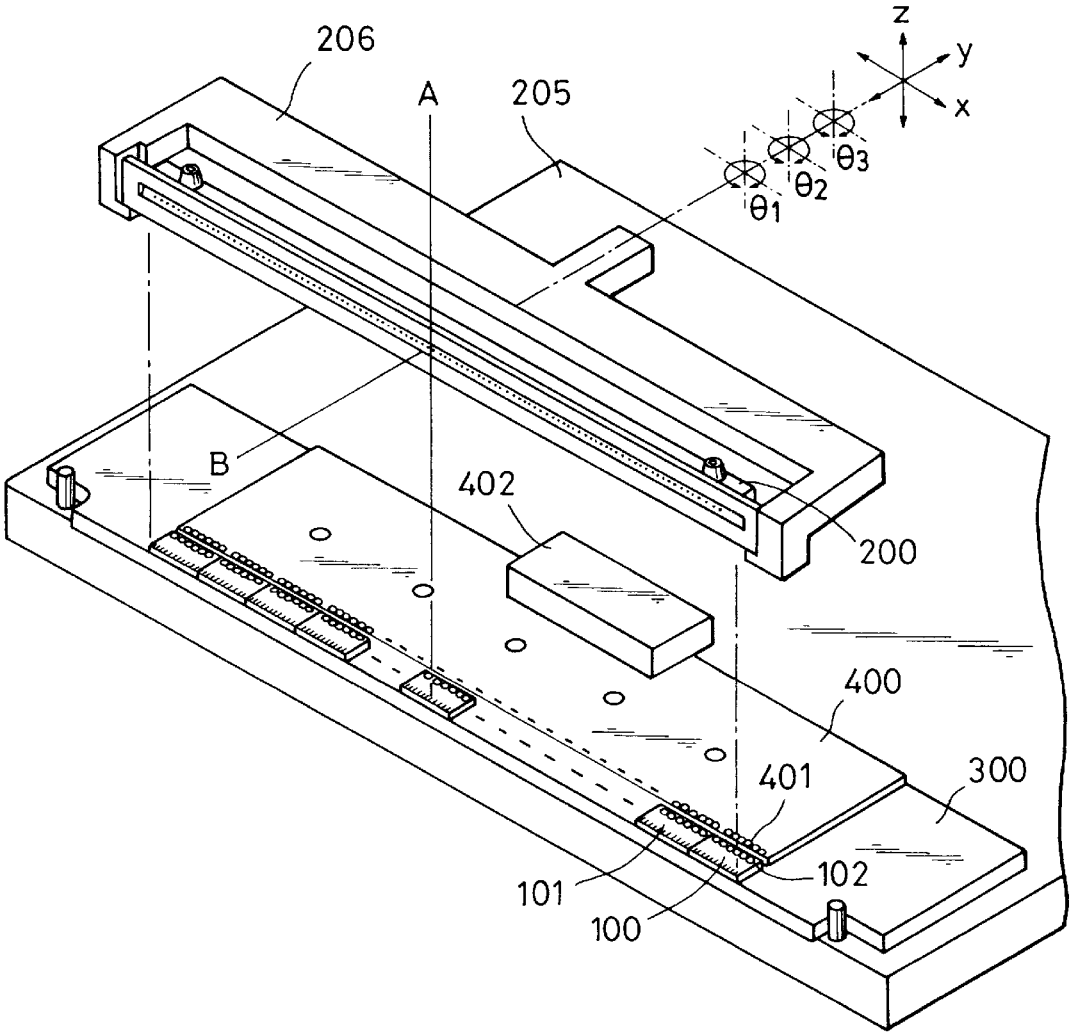
FIG. 12 is a drawing illustrating a method of producing the print head shown in FIG. 9.
Figure 13:
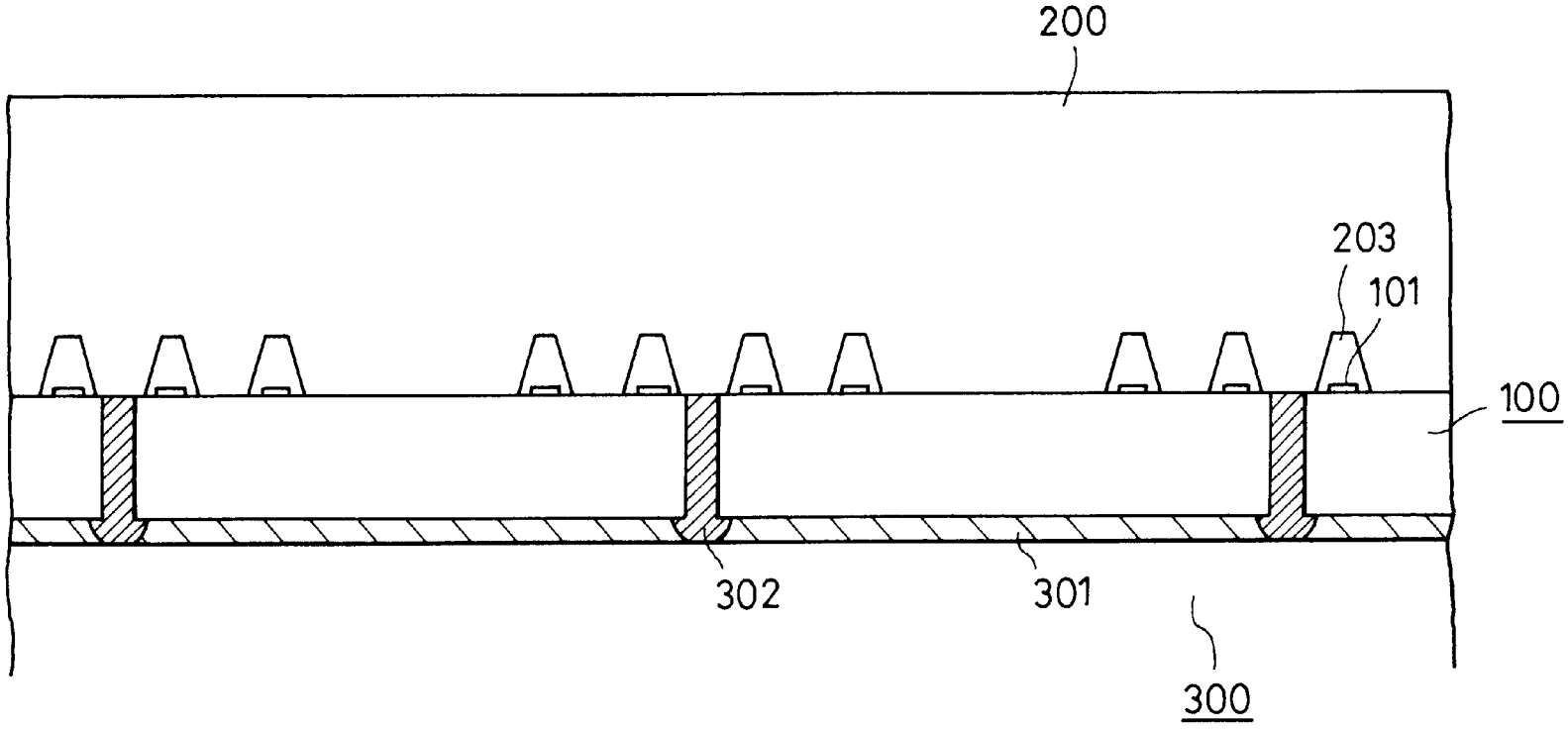
FIG. 13 is a sectional view illustrating the state where the print head and the top plate shown in FIG. 9 are bonded.

COLUMN 6:

Line 10, "FIG. 11(a), (b) and (c)" should read --FIGS. 11(a), 11(b) and 11(c)--.

Line 65, "(b)" should read --2(b)--.

COLUMN 7:

Line 65, "heat" should read --heater--.

UNITED STATES PATENT AND TRADEMARK OFFICE

CERTIFICATE OF CORRECTION

PATENT NO. : 5,980,020

DATED : November 9, 1999

INVENTOR(S) : YASUSHI MIURA ET AL.

It is certified that error appears in the above-identified patent and that said Letters Patent is hereby corrected as shown below:

COLUMN 8:
Line 66, "(c)" should read --8(c)--.

COLUMN 9:
Line 1, "(c)," should read --8(c),--.
Line 59, "right angle" should read --right-angle--.

COLUMN 10:
Line 12, "connected" should read --connection--.

Signed and Sealed this

Twelfth Day of December, 2000

*Attest:*

Q. TODD DICKINSON

*Attesting Officer*

*Director of Patents and Trademarks*